US006023156A

United States Patent [19]

Buhler

[11] Patent Number: 6,023,156

[45] Date of Patent: Feb. 8, 2000

[54] SWITCHED LOAD VOLTAGE REGULATION CIRCUIT

[75] Inventor: Otto R. Buhler, Boulder, Colo.

[73] Assignee: Storage Technology Corporation, Louisville, Colo.

[21] Appl. No.: 09/213,004

[22] Filed: Dec. 16, 1998

[51] Int. Cl.[7] ..... G05F 1/44

[52] U.S. Cl. ..... 323/284; 323/282

[58] Field of Search ..... 323/282, 283, 323/284, 351, 312; 365/226; 327/541

[56] References Cited

U.S. PATENT DOCUMENTS

| | | | |
|---|---|---|---|
| 3,582,765 | 6/1971 | McCabe | 323/263 |
| 4,782,241 | 11/1988 | Baker et al. | 307/66 |
| 5,448,156 | 9/1995 | Tsay | 323/312 |
| 5,552,739 | 9/1996 | Keeth et al. | 327/538 |
| 5,684,682 | 11/1997 | Zhong et al. | 363/59 |
| 5,726,944 | 3/1998 | Pelley, III et al. | 365/226 |
| 5,744,935 | 4/1998 | Khoury | 320/107 |
| 5,783,934 | 7/1998 | Tran | 323/312 |

*Primary Examiner*—Adolf Deneke Berhane
*Attorney, Agent, or Firm*—Brooks & Kushman P.C.

[57] ABSTRACT

Low voltage switched loads, such as magnetic tape write drivers, require a power source with a regulated voltage. A voltage regulator circuit includes a switched voltage regulator having an unregulated voltage input connected to an unregulated voltage source and an enabling input. The voltage regulator produces a regulated voltage at an output when the enabling input is asserted and produces high impedance at the output when the enabling input is unasserted. A capacitor is connected between the regulated voltage output and common voltage. A controlled precharge switch in series with a precharge resistor is connected between the unregulated source and the regulated voltage output. The precharge switch has a precharging input which closes the precharge switch when the precharging input is asserted. The circuit also includes a control logic operative to unassert the enabling input, assert the precharging input to close the precharging switch, unassert the precharging input after sufficient time to charge the capacitor to a voltage substantially the same as the regulated voltage, and assert the enabling input.

13 Claims, 8 Drawing Sheets

SWITCHED LOAD VOLTAGE REGULATION CIRCUIT

TECHNICAL FIELD

The present invention relates to circuits for supplying regulated voltage to switched loads.

BACKGROUND ART

Voltage regulation circuits accept unregulated voltage and produce a constant regulated voltage output which rejects fluctuations of the input supply voltage and may also provide over voltage protection, over current protection, temperature regulation, and the like. One application for a voltage regulation circuit is for supplying power to digital magnetic tape write drivers. The write drivers output a substantially constant current which changes direction in response to a digital input signal. The current is converted by a write head into a magnetic field which imposes a field pattern on a passing magnetic tape. At times when no write signal is desired, the write drivers are switched off to prevent any current from reaching the write heads. The write drivers, therefore, appear as a switched load to the voltage regulation circuit.

In order to minimize power dissipation, the level of the regulated voltage supplied to the write drivers is reduced. However, the inductance and resistance of the power distribution system is relatively unchanged. Since the required write current is independent of regulated supply voltage, power distribution perturbances become an increasingly greater percentage of the write current. An additional problem in low dissipation voltage regulation circuits occurs as the ratio of the regulated output voltage to the unregulated input voltage is minimized. Typically, series monitoring elements such as current sense resistors are used to sense turn-on current and provide soft start during regulator turn-on. Minimizing the output-to-input voltage ratio precludes the use of series monitoring elements which may result in unacceptably high turn-on current. Such high turn-on currents may trip protection circuits in the unregulated input voltage or may even cause a failure of the unregulated input supply.

What is needed is a voltage regulation circuit that can operate at low voltages without permitting high turn-on current surges. The voltage regulation circuit should supply regulated voltage to a switched load such as magnetic tape write drivers.

DISCLOSURE OF INVENTION

It is an object of the present invention to provide a voltage regulator circuit for use with a switched load.

Another object of the present invention is to provide a voltage regulator circuit for operation at low voltages.

Still another object of the present invention is to provide a voltage regulator circuit for operation when the unregulated input voltage level is close to the regulated output voltage level.

Yet another object of the present invention is to provide a voltage regulation circuit with low turn-on current.

A further object of the present invention is to provide a voltage regulation circuit for use with magnetic tape write drivers.

In carrying out the above objects and other objects and features of the present invention, a circuit is provided for supplying regulated voltage to a switched load. The circuit includes a switched voltage regulator having an unregulated voltage input connected to an unregulated voltage source, a common input connected to a common voltage, an enabling input, and a regulated voltage output. The voltage regulator produces a regulated voltage at the output when the enabling input is asserted and produces high impedance at the output when the enabling input is unasserted. A capacitor is connected between the regulated voltage output and the common voltage. A controlled precharge switch in series with a precharge resistor is connected between the unregulated source and the regulated voltage output. The precharge switch has a precharging input which closes the precharge switch when the precharging input is asserted. The circuit also includes a control logic operative to unassert the enabling input, assert the precharging input to close the precharging switch, unassert the precharging input after sufficient time to charge the capacitor to a voltage substantially the same as the regulated voltage, and assert the enabling input.

In an embodiment of the present invention, the switched load is enabled when a loading input is asserted and disabled when the loading input is unasserted. The control logic unasserts the loading input at a time no later than when the precharging input is asserted. The control logic also asserts the loading input at a time no earlier than when the precharging input is unasserted.

In another embodiment of the present invention, a controlled preload switch in series with a preload resistor is connected between the regulated voltage output and the common voltage. The preload switch has a preloading input which closes the preload switch when the preloading input is asserted. The control logic unasserts the enabling input, asserts the precharging input, and unasserts the precharging input after sufficient time to charge the capacitor to a voltage substantially the same as the regulated voltage. The control logic asserts the enabling input, asserts the preloading input, and unasserts the preloading input after sufficient time to permit transient voltages on the regulated voltage output to decay.

In still another embodiment of the present invention, the control logic asserts the preloading input at a time no earlier than when the loading input is unasserted but before a time when the precharging input is asserted so as to discharge the capacitor. The control logic unasserts the preloading input at a time no later than when the precharging input is asserted.

In yet another embodiment of the present invention, the resistance value of the preload resistor is substantially the same as the switched load when the loading input is asserted.

The above objects and other objects, features, and advantages of the present invention are readily apparent from the following detailed description of the best mode for carrying out the invention when taken in connection with the accompanying drawings.

BRIEF DESCRIPTION OF DRAWINGS

FIG. 7 is a schematic diagram illustrating magnetic tape write drivers supplied by a voltage regulator circuit according to the present invention;

FIG. 9 is a plot illustrating regulated voltage output without precharging and preloading during voltage regulator circuit turn-on;

BEST MODE FOR CARRYING OUT THE INVENTION

Figure 1:
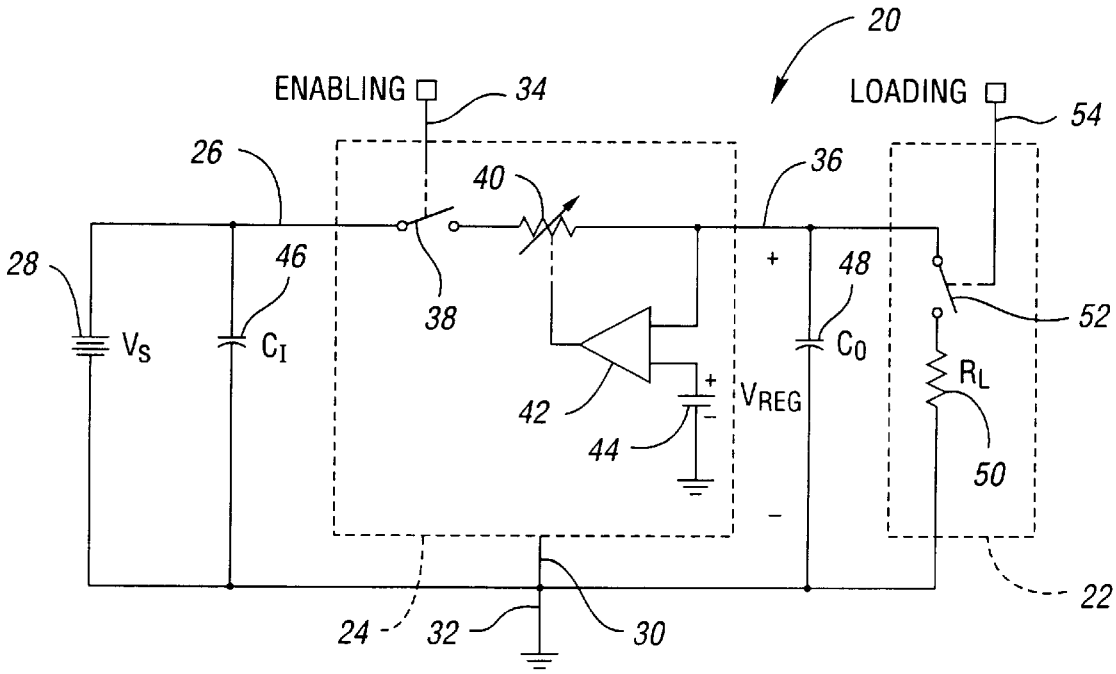
Fig. 1 (PRIOR ART)
FIG. 1 is a schematic diagram of a prior art voltage regulator circuit supplying a switched load.

Referring now to FIG. 1, a schematic diagram of a prior art voltage regulator circuit supplying a switched load is shown. Voltage regulator circuit 20 supplies regulated voltage to switched load 22. Voltage regulator circuit 20 includes switched voltage regulator 24. Switched voltage regulator 24 has unregulated voltage input 26 connected to unregulated voltage source 28 supplying unregulated voltage $V_S$. Voltage regulator 24 has common input 30 connected to common voltage 32. Enabling input 34 controls regulated voltage output 36. Internally, switched voltage regulator 24 can be modeled using switch 38 in series with variable resistor 40 between input 26 and output 36. The output of comparator 42 controls variable resistor 40 by comparing the voltage on output 36 to reference voltage 44. Switch 38 is controlled by signal ENABLING on enabling input 34. When ENABLING is asserted, switch 38 is closed, and voltage regulator 24 attempts to keep the voltage level on output 36, shown as $V_{REG}$, at a constant regulated voltage level, VR. When ENABLING is unasserted, switch 38 is open, and output 36 appears as a high impedance load to switched load 22.

Voltage regulator circuit 20 may also include input capacitor $C_1$, indicated by 46, and output capacitor $C_0$, indicated by 48. Input capacitor 46 may represent an input filter capacitor as well as capacitance in the distribution between unregulated voltage source 28 and voltage input 26. Output capacitor 48 may represent one or more output filter capacitors, decoupling capacitors, capacitance in load 22, and capacitance in the distribution system between regulated voltage output 36 and load 22.

Switched load 22 may be modeled by load resistor $R_L$, indicated by 50, in series with switch 52. Switch 52 is controlled by loading input 54. When control signal LOADING on loading input 54 is asserted, switch 52 is closed connecting load resistor 50 to regulated voltage output 36. When LOADING is unasserted, switch 52 is opened disconnecting load resistor 50 from regulated voltage output 36.

Figure 2:
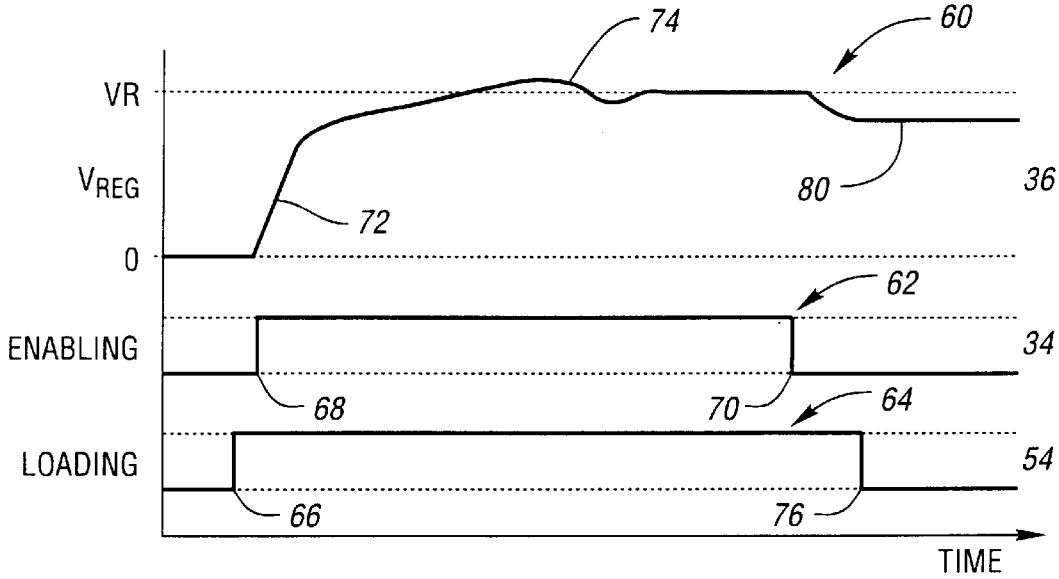
Fig. 2 (PRIOR ART)
FIG. 2 is a timing diagram illustrating regulated output voltage for the voltage regulator circuit of FIG. 1.

Referring now to FIG. 2, a timing diagram illustrating regulated output voltage for the voltage regulator circuit of FIG. 1 is shown. Regulated voltage signal 60 is shown as a function of ENABLING signal 62 and LOADING signal 64. LOADING signal 64 on loading input 54 is asserted at time 66 switching the load 22 onto regulated voltage output 36. ENABLING signal 62 on enabling input 34 is then asserted at time 68. Regulated voltage signal 60 rises and settles to regulated voltage level VR prior to ENABLING signal 62 being unasserted at time 70.

When switched voltage regulator 24 is first enabled at time 68, voltage signal 60 rises steeply as voltage regulator 24 attempts to bring the voltage level on output 36 to regulated voltage VR, as indicated by 72. Since the current at output 36 is the product of the time rate of change of regulated voltage signal 60 and output capacitor 48, a very high turn-on current from supply 28 is required. This may trip protection circuits in supply 28 or regulator 24 or may result in the failure of supply 28. Typically, an element such as a resistor is placed in series with output 36. The element is used to monitor the current on output 36 and open switch 38 if the current is excessive. However, for low voltage systems where the regulated voltage level, VR, on output 36 is close to the unregulated voltage level on input 26, series elements for monitoring turn-on current are not practical. Another potential problem is transients in regulated voltage signal 60, as indicated by 74. These transients may result due to inductance in load 22 and the distribution system between output 36 and load 22. Yet another difficulty may occur if load 22 is switched off at time 76. Voltage in output capacitor 48 can no longer discharge, as indicated by 80. This creates difficulties for certain types of loads 22. For example, if switched load 22 is one or more write drivers, power to the write drivers may result in an unintentional write splash onto magnetic tape in certain failure modes.

Figure 3:
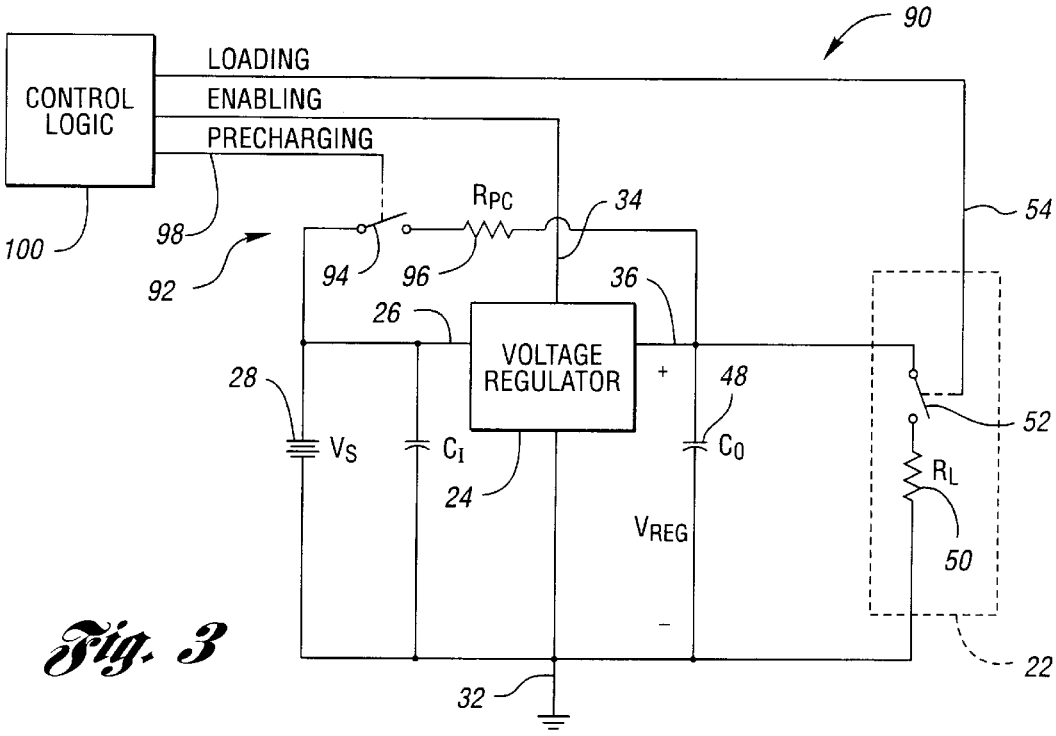
FIG. 3 is a schematic diagram of a voltage regulator circuit according to an embodiment of the present invention.

Referring now to FIG. 3, a schematic diagram of a voltage regulator circuit according to an embodiment of the present invention is shown. The voltage regulator circuit, shown generally by 90, includes a precharging circuit, shown generally by 92, comprising switch 94 in series with precharging resistor $R_{PC}$ connected between unregulated voltage input 26 and regulated voltage output 36. Switch 94 is controlled by precharging input 98 connected to control logic 100. When PRECHARGING signal on precharging input 98 is asserted, switch 94 is closed and precharging resistor 96 is connected between input 26 and output 36. When PRECHARGING signal on precharging input 98 is unasserted, switch 94 is opened, disconnecting precharging resistor 96. Enabling input 34 and loading input 54 are also connected to control logic 100. Precharging circuit 92 allows output capacitor 48 to be charged to a voltage substantially the same as regulated voltage level VR prior to turning on voltage regulator 24 with enabling input 34.

Figure 4:
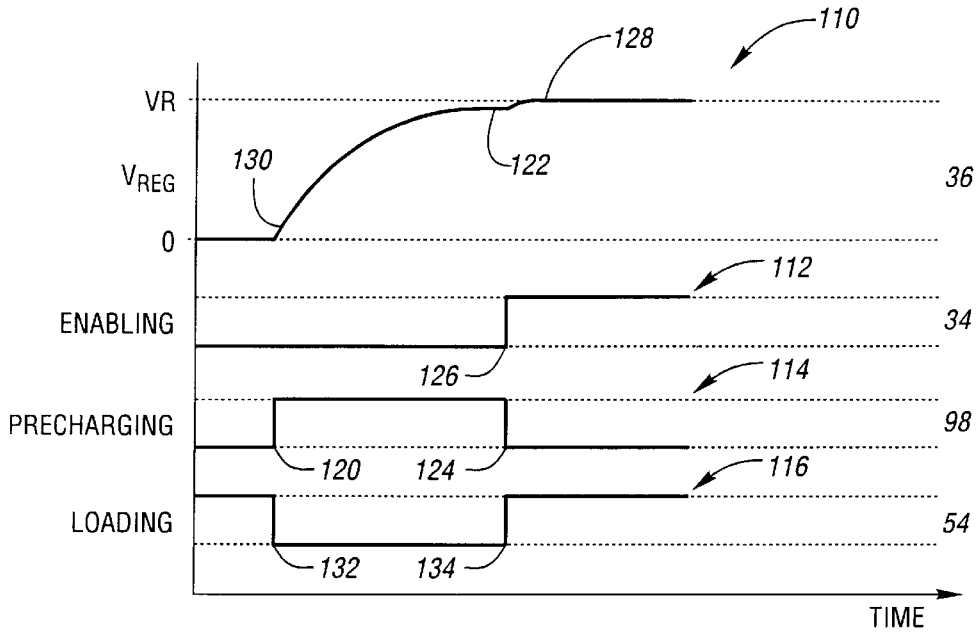
FIG. 4 is a timing diagram illustrating regulated output voltage for the voltage regulator circuit of FIG. 3.

Referring now to FIG. 4, a timing diagram illustrating regulated output voltage for the voltage regulator circuit of FIG. 3 is shown. Regulated voltage signal 110 is shown as a function of ENABLING signal 112 on enabling input 34, PRECHARGING signal 114 on precharging input 98, and LOADING signal 116 on loading input 54. Control logic 100 asserts PRECHARGING signal 114 at time 120. Output capacitor 48 begins to charge as shown by 122. Control logic 100 deasserts PRECHARGING signal 114 after sufficient time 124 to charge output capacitor 48 to a voltage substantially the same as the desired regulated voltage VR. Control logic 100 asserts ENABLING signal 112 at time 126 bringing regulated voltage signal 110 to desired voltage level VR as indicated by 128. The value of precharging resistor 96 is chosen such that the time rate of change of regulated voltage signal 110 when switch 94 is closed, indicated by 130, produces a current that can be easily delivered by unregulated supply 28.

In an embodiment of the present invention, control logic 100 controls switch load 22 using LOADING signal 116 on loading input 54. Control logic 100 unasserts loading input 54 at a time 132 no later than when precharging input 98 is asserted. Control logic 100 asserts loading input 54 at time 134 no earlier than when precharging input 98 is unasserted.

Figure 5:
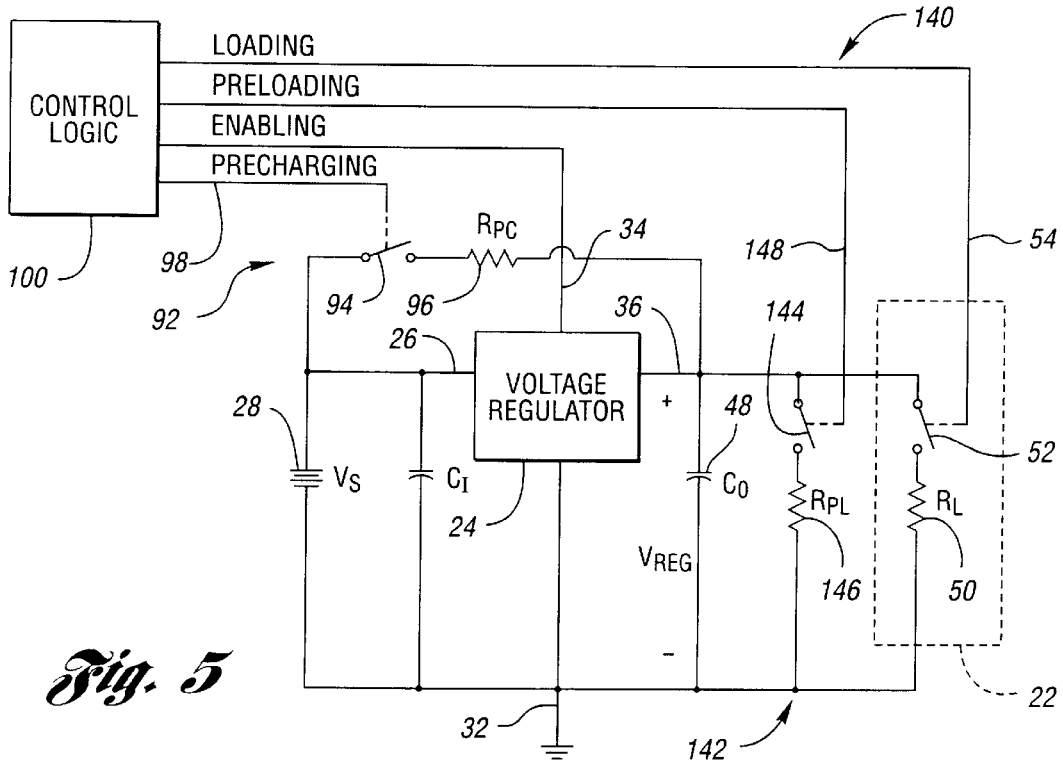
FIG. 5 is a schematic diagram of a voltage regulator circuit according to an embodiment of the present invention including a preload resistor.

Referring now to FIG. 5, a schematic diagram of a voltage regulator circuit according to an embodiment of the present invention including a preload resistor is shown. A voltage regulator circuit, shown generally by 140, includes a preloading circuit, shown generally by 142, having switch 144 in series with preloading resistor 146 connected between regulated voltage output 36 and common voltage 32. Switch 144 is controlled by preloading input 148 connected to control logic 100. When a PRELOADING signal on preloading input 148 is asserted, switch 144 is closed and preloading resistor 146 is connected across output 36, in parallel with output capacitor 48 and load 22. When PRELOADING signal on preloading input 148 is unasserted, switch 144 is open disconnecting preloading resistor 146. Preloading resistor 146 permits transients on output 36 to decay prior to switching in load 22. In a preferred embodiment, the resistance value of preload resistance 146 is substantially the same as the resistance represented by load resistor 50.

Figure 6:
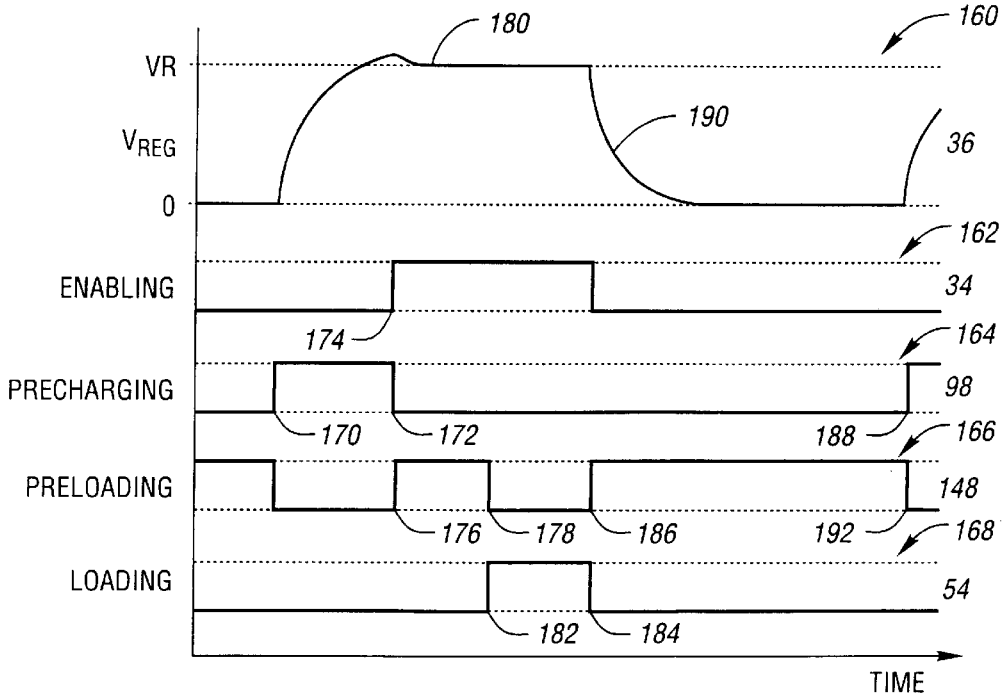
FIG. 6 is a timing diagram illustrating regulated output voltage for the voltage regulator circuit of FIG. 5.
Figure 2:
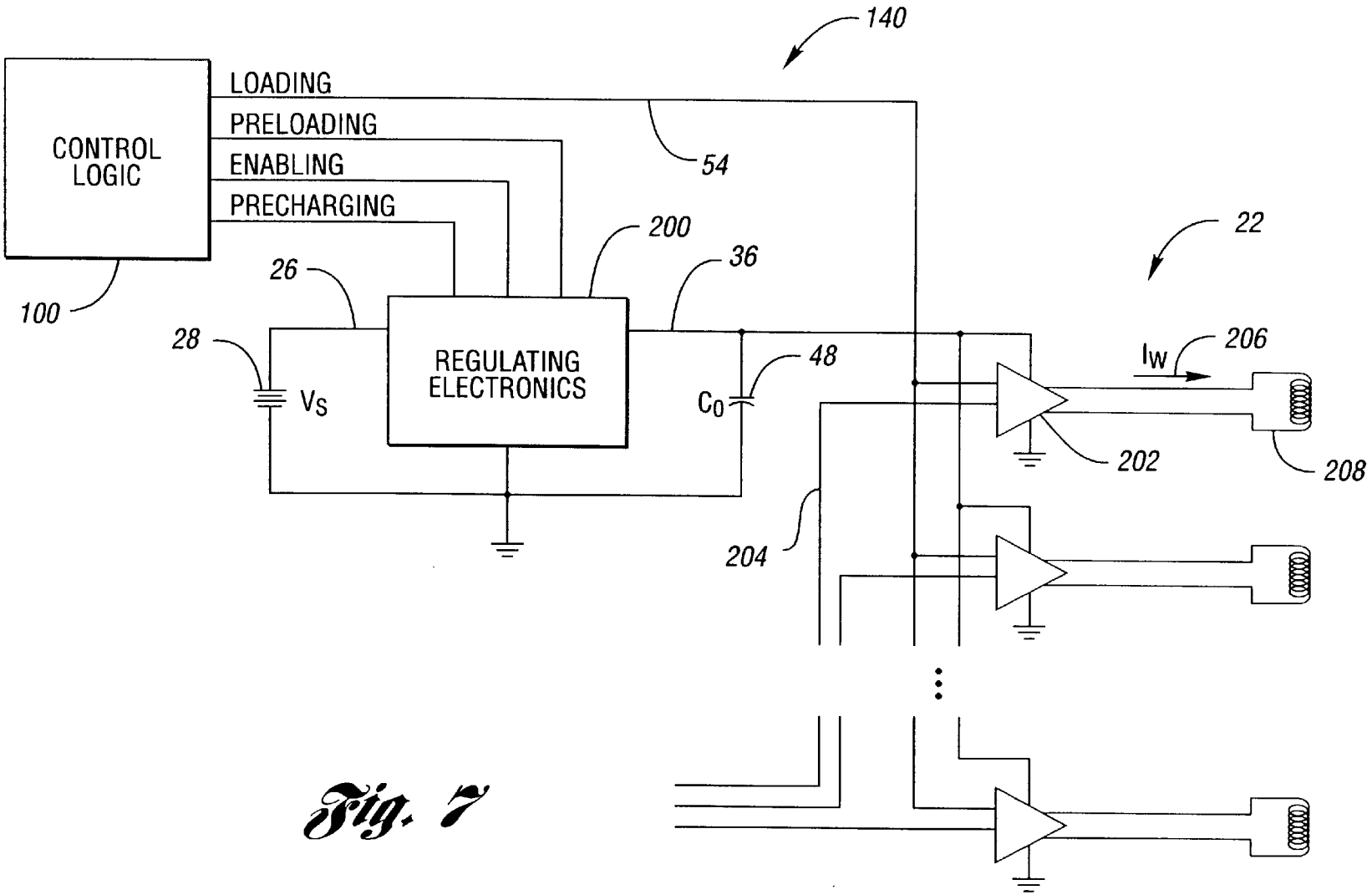

Referring now to FIG. 6, a timing diagram illustrating regulated output voltage for the voltage regulator circuit of FIG. 5 is shown. Regulated voltage signal 160 is a function of ENABLING signal 162 on enabling input 34, PRECHARGING signal 164 on precharging input 98, PRELOADING signal 166 on preloading input 148, and LOADING signal 168 on loading input 54. Precharging occurs between time 170 and time 172 as described with regards to FIGS. 3 and 4 above. Control logic 100 asserts ENABLING signal 162 at time 174. Control logic 100 asserts PRELOADING signal 166 at time 176 and deasserts PRELOADING signal 166 at time 178 sufficiently past time 176 to permit transient voltages in regulated voltage signal 160 on output 36 to decay as indicated by 180. In an embodiment of the present invention, control logic 100 asserts LOADING signal 168 at time 182 substantially the same time as time 178 when PRELOADING signal 166 is unasserted.

In another embodiment of the present invention, preload resistor 146 is used to drain voltage from output capacitor 48. Control logic 100 deasserts LOADING signal 168 at time 184. Control logic 100 asserts PRELOADING signal 166 at time 186 no earlier than time 184 but before time 188 when PRECHARGING signal 164 is asserted to start another precharging. This discharges voltage stored in output capacitor 48, as indicated by 190, in regulated voltage signal 160 on output 36. Control logic 100 unasserts PRELOADING signal 166 at time 192 no later than time 188 when PRECHARGING signal 164 is asserted.

Referring now to FIG. 7, a schematic diagram illustrating magnetic tape write drivers supplied by a voltage regulator circuit according to the present invention is shown. For clarity, voltage regulator circuit 140 is shown as control logic 100 and regulating electronics 200. Voltage regulator circuit 140 supplies regulated power to a plurality of tape write drivers, one of which is indicated by 202, implementing switched load 22. Each write driver 202 accepts digital input 204 and produces write current 206 when loading input 54 is asserted. Ideally, write current 206 has a constant magnitude and a current direction based on the logical level on digital input 204. Write current 206 flows through coil 208 in a write head, not shown for clarity, to produce a magnetic field. This magnetic field induces a readable change in a passing magnetic tape. As such, write drivers 202 present a relatively constant current load to voltage regulator circuit 140 when loading input 54 is asserted.

Figure 8:
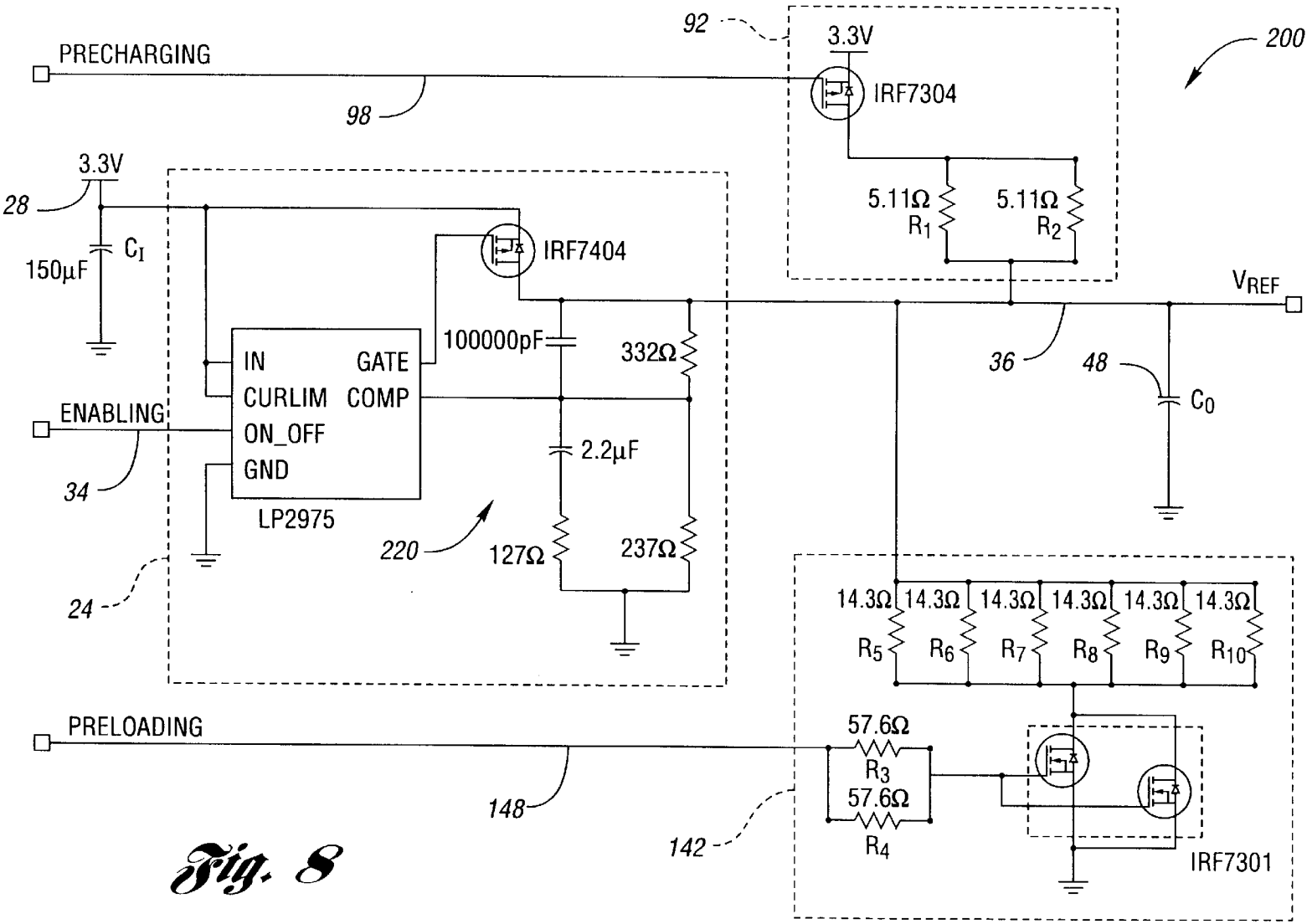
FIG. 8 is a detailed schematic diagram illustrating an implementation of a voltage regulator circuit according to an embodiment of the present invention.

Referring now to FIG. 8, a detailed schematic diagram illustrating an implementation of a voltage regulator circuit according to an embodiment of the present invention is shown. Regulating electronics 200 are designed to supply write drivers 202 representing a switched 1.6 amp load. Output capacitor 48 is approximately 600 $\mu$F. Unregulated voltage supply 28 is 3.3 volts and desired regulated voltage, VR, is 3.0 volts.

Switched voltage regulator 24 is implemented using a MOSFET LDO Driver/Controller by National Semiconductor designated LP2975. The LP2975 includes comparator 42, reference voltage 44, and switch 38. Variable resistor 40 is implemented with PMOS FET IRF7404 by International Rectifier. The RC network, shown generally by 220, provides frequency compensated feedback from output 36 to comparator 42.

Precharging circuit 92 implements switch 94 using PMOS FET IRF7304 by International Rectifier with source connected to unregulated power source 28 and gate connected to precharging input 98. Precharging resistor 96 is implemented by the parallel combination of resistors R1 and R2 between the drain of IRF7304 and output 36. Switch 94 asserts with a low logic level.

Preloading circuit 142 implements switch 144 using a pair of parallel NMOS FETs in package IRF7301 from International Rectifier having drains connected to common voltage 32 and gates connected through parallel resistors R3 and R4 to preloading input 148. The parallel combination of R5 through R10 connected between the sources of the FETs in IRF7301 and output 36 provide preloading resistor 146.

In FIGS. 9 through 14, actual test data from voltage regulator circuit 140 including regulating electronics 200 described in FIG. 8 above are shown. In each plot, a regulated voltage signal is shown together with control signals. The control signals are plotted on a different amplitude scale and are provided to indicate timing.

Figure 9:
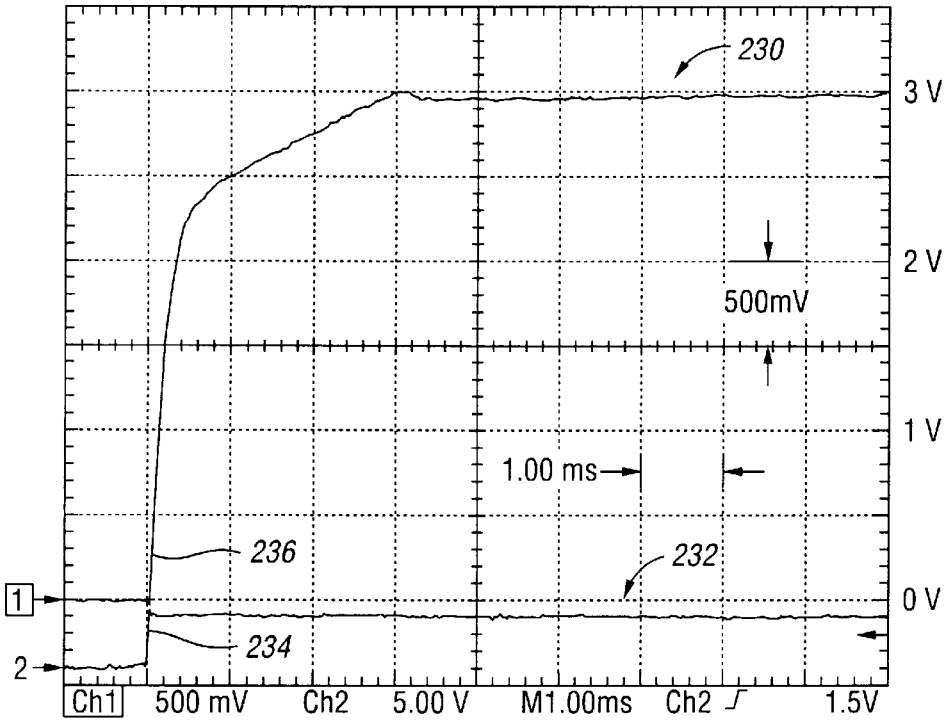

Referring now to FIG. 9, a plot illustrating regulated voltage output without precharging and preloading during voltage regulator circuit turn-on is shown. Regulated voltage signal 230 appearing at output 36 is shown as a function of ENABLING signal 232 on enabling input 34. Without precharging, when ENABLING signal 232 is asserted at time 234, regulated voltage signal 230 exhibits a great rate of change, as indicated by 236. For output capacitor 48 having 600 $\mu$F, the current on output 36 is approximately 11 amps.

Figure 10:
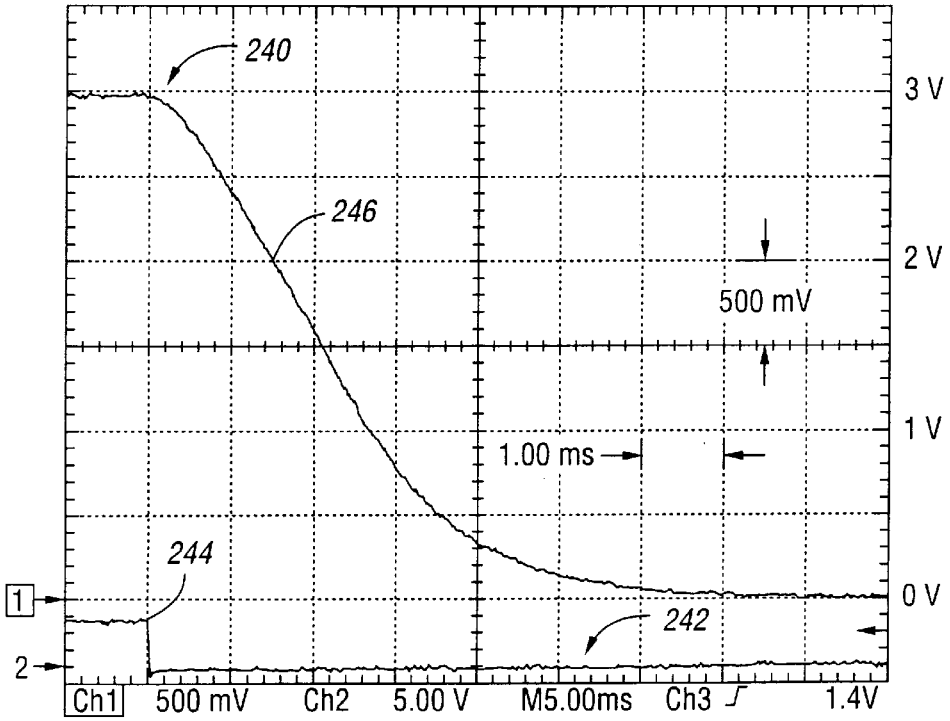
FIG. 10 is a plot illustrating regulated voltage output without precharging and preloading during voltage regulator circuit turn-off.

Referring now to FIG. 10, a plot illustrating regulated voltage output without precharging and preloading during voltage regulator turn-off is shown. Regulated voltage signal 240 on output 36 is shown as a function of ENABLING signal 242 on enabling input 34. At time 244, ENABLING signal 242 is deasserted The voltage stored in output capacitor 48 begins to discharge through load 22, as indicated by 246. During this time, write drivers 202 may produce spurious write currents 206 if loading input 54 is asserted.

Figure 11:
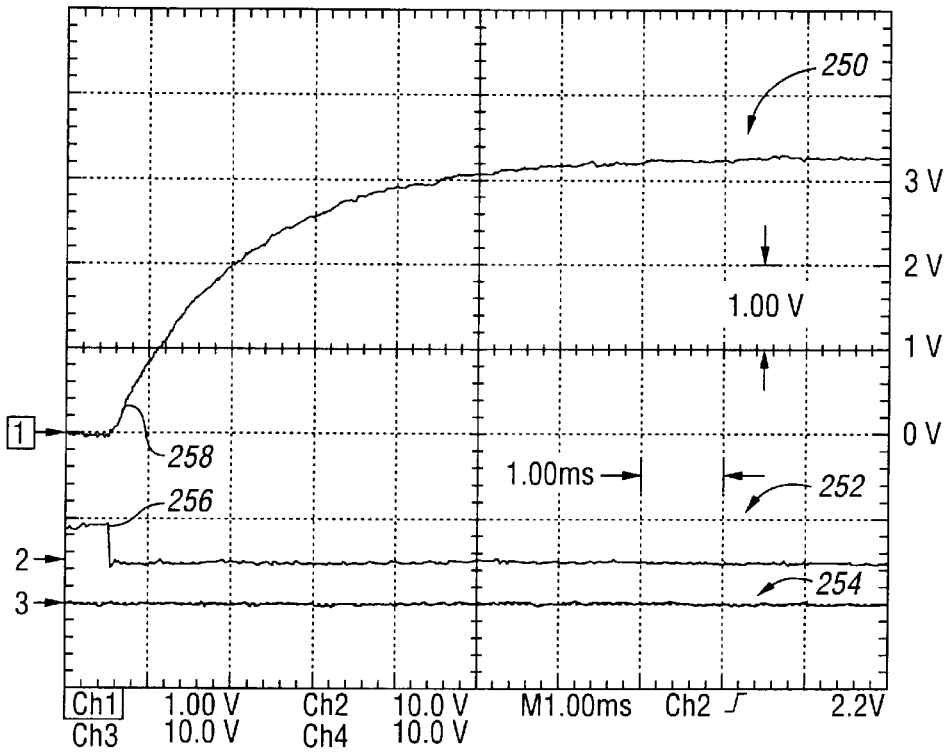
FIG. 11 is a plot illustrating regulated voltage output with precharging and no preloading.

Referring now to FIG. 11, a plot illustrating regulated voltage output with precharging and no preloading is shown. Regulated voltage signal 250 on output 36 is shown as a function of low asserting PRECHARGING signal 252 on precharging input 98 and ENABLING signal 254 on enabling input 34. ENABLING signal 254 is unasserted. PRECHARGING signal 252 becomes asserted at time 256 causing output capacitor 48 to charge, as indicated by 258. The initial time rate of change of regulated voltage signal 250 is substantially less with precharging, resulting in a turn-on current of approximately 1.3 amps.

Figure 12:
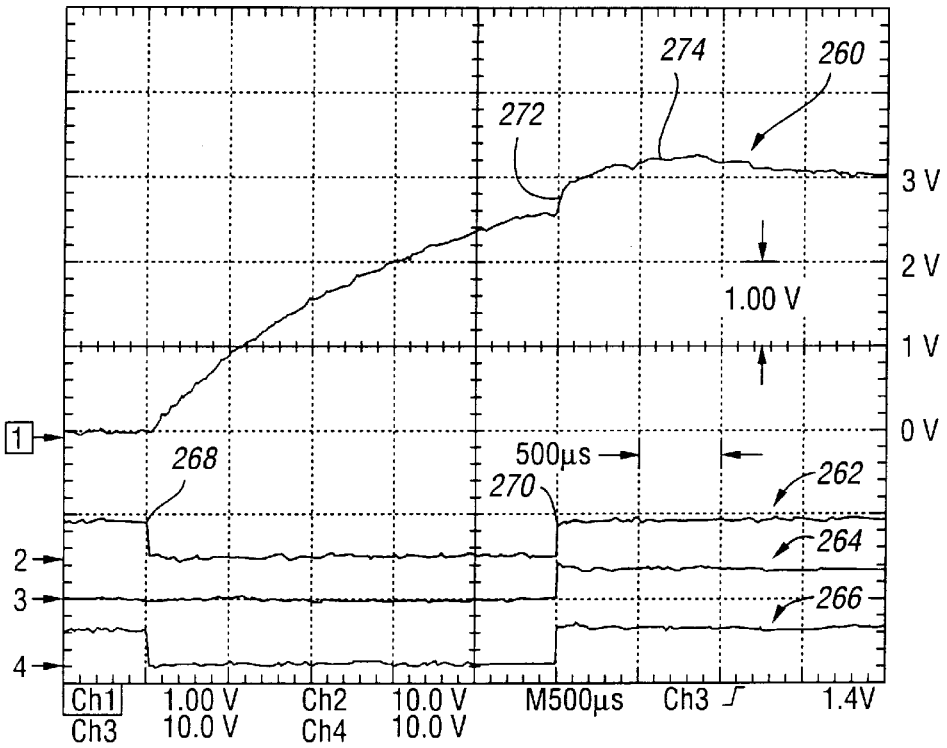
FIG. 12 is a plot illustrating regulated voltage output with precharging and no preloading with loading prior to complete precharging.

Referring now to FIG. 12, a plot illustrating regulated voltage output with precharging and no preloading with loading prior to complete precharging is shown. Regulated voltage signal 260 on output 36 is shown as a function of low asserting PRECHARGING signal 262 on precharging input 98, ENABLING signal 264 on enabling input 34, and LOADING signal 266 on loading input 54. Precharging begins at time 268 and ends at time 270 when PRECHARGING signal 262 is unasserted, ENABLING signal 264 is asserted, and LOADING signal 266 is asserted. A jump in regulated voltage signal 260, shown by 272, results because of the difference between the voltage level on output 36 at the end of precharging and the regulated voltage on output 36. Signal jump 272 results in a brief current surge at output 36 of approximately 5 amps. Transient 274 in regulated voltage signal 260 results from signal jump 272. Signal jump 272 and transient 274 may be greatly reduced through the inclusion of preloading circuit 142 and by bringing the voltage on output 36 at the end of precharging closer to the desired regulated output voltage.

Figure 13:
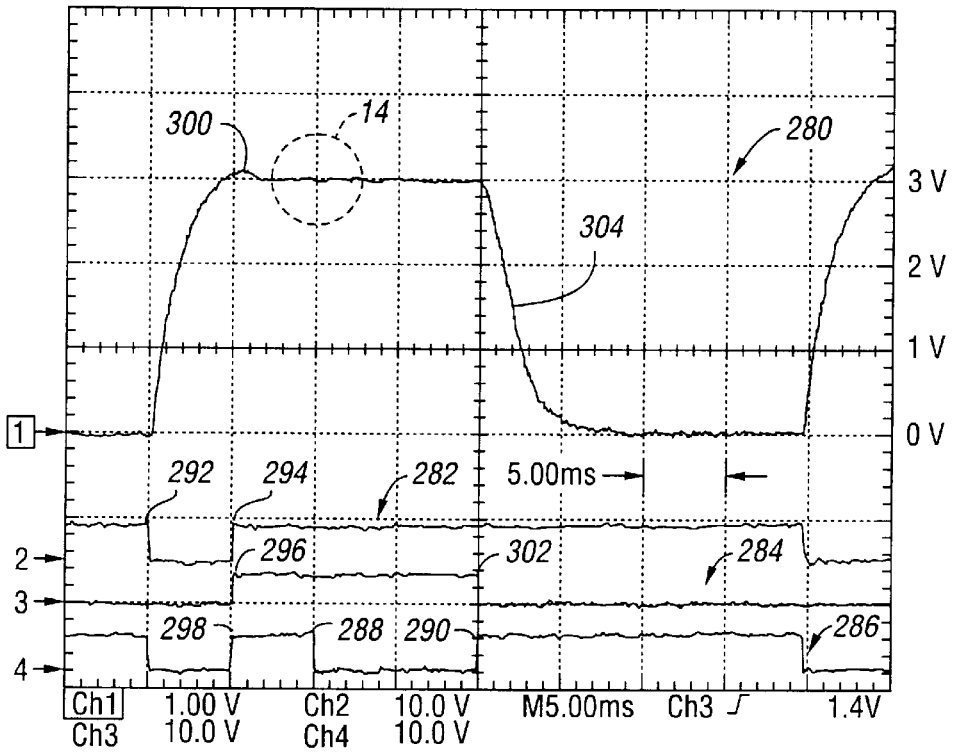
FIG. 13 is a plot illustrating regulated voltage output with precharging and preloading over a loading cycle.

Referring now to FIG. 13, a plot illustrating regulated voltage output with precharging and preloading over a loading cycle is shown. Regulated voltage signal 280 on output 36 is shown as a function of low asserting PRECHARGING signal 282 on precharging input 98, ENABLING signal 284 on enabling input 34, and PRELOADING signal 286 on preloading input 148. Although not shown, loading input 54 is asserted at time 288 and unasserted at time 290 during which time write drivers 202 are active. Precharging occurs between time 292 and time 294 by asserting PRECHARGING signal 282. ENABLING signal 284 is asserted at time 296 and PRELOADING signal 286 is asserted at time 298. Transients in regulated voltage signal 280, shown by 300, are dampened by preload resistor 146. At time 288, PRELOADING signal 286 is unasserted and loading input 54 is asserted. Regulated voltage signal 280 during the switch between preload resistor 146 and load 22 is described with regards to FIG. 14 below. When load 22 is switched off at time 290, PRELOADING signal 286 is asserted. At time 302, ENABLING signal 284 is unasserted. Preload resistor 146 discharges voltage stored in output capacitor 48, as indicated by 304.

Figure 14:
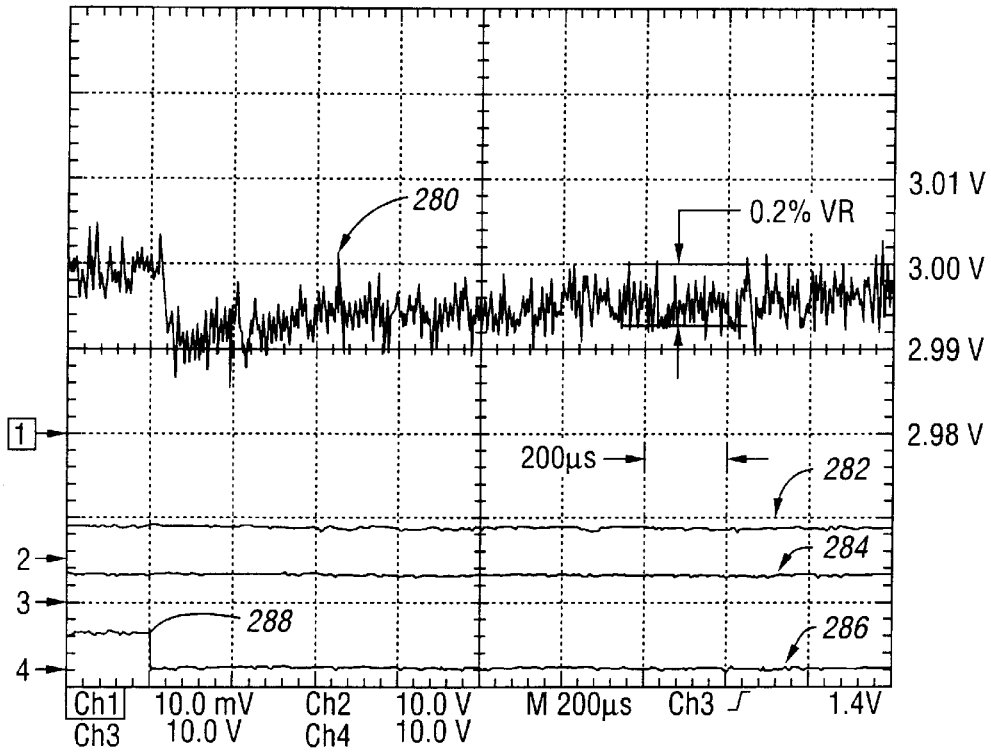
FIG. 14 is a plot illustrating regulated output with precharging and preloading when loading occurs.

Referring now to FIG. 14, a plot illustrating regulated voltage output with precharging and preloading when loading occurs is shown. At time 288, preloading resistor 146 is disconnected from output 36 and load 22 is connected to output 36. As can be seen in regulated voltage signal 280, a slight dip occurs in the voltage level on output 36 with regulated voltage signal 280 coming within 0.2% of VR within about 1.5 ms.

While embodiments of the invention have been illustrated and described, it is not intended that these embodiments illustrate and describe all possible forms of the invention. Rather, the words used in the specification are words of description rather than limitation, and that various changes may be made without departing from the spirit and scope of the invention.

What is claimed is:

1. A voltage regulation circuit for supplying regulated voltage to a switched load comprising:

a switched voltage regulator having an unregulated voltage input connected to an unregulated voltage source, a common input connected to common voltage, an enabling input, and a regulated voltage output, the voltage regulator operative to produce a regulated voltage at the output when the enabling input is asserted and to produce high impedance at the output when the enabling input is unasserted;

a capacitor connected between the regulated voltage output and the common voltage;

a controlled precharge switch in series with a precharge resistor connected between the unregulated source and the regulated voltage output, the precharge switch having a precharging input operative to close the precharge switch when the precharging input is asserted and to open the precharging switch when the precharging input is unasserted; and a control logic in communication with the enabling input and the precharging input, the control logic operative to (a) unassert the enabling input, (b) assert the precharging input to close the precharging switch, (c) unassert the precharging input to open the precharging switch after sufficient time to charge the capacitor to a voltage substantially the same as the regulated voltage, and (d) assert the enabling input.

2. A voltage regulation circuit as in claim 1, the switched load enabled when a loading input is asserted and disabled when the loading input is unasserted, wherein the control logic is further operative to:

unassert the loading input at a time no later than when the precharging input is asserted; and assert the loading input at a time no earlier than when the precharging input is unasserted.

3. A voltage regulation circuit as in claim 1 further comprising a controlled preload switch in series with a preload resistor connected between the regulated voltage output and the common voltage, the preload switch having a preloading input operative to close the preload switch when the preloading input is asserted and to open the preload switch when the preloading input is unasserted, the control logic further in communication with the preloading input wherein the control logic is operative to unassert the enabling input;

assert the precharging input to close the precharge switch;

unassert the precharging input to open the precharge switch after sufficient time to charge the capacitor to a voltage substantially the same as the regulated voltage;

assert the enabling input;

assert the preloading input to close the preload switch; and unassert the preloading input to open the preload switch after sufficient time to permit transient voltages on the regulated voltage output to decay.

4. A voltage regulation circuit as in claim 3, the switched load enabled when a loading input is asserted and disabled when the loading input is unasserted, wherein the control logic is further operative to:

unassert the loading input at a time no later than when the precharging input is asserted; and assert the loading input at substantially the same time as when the preloading input is unasserted.

5. A voltage regulation circuit as in claim 4 wherein the control logic is further operative to assert the preloading input at a time no earlier than when the loading input is unasserted but before a time when the precharging input is asserted so as to discharge the capacitor thereby; and unassert the preloading input at a time no later than when the precharging input is asserted.

6. A voltage regulation circuit as in claim 3 wherein the resistance value of the preload resistor is substantially the same as the switched load when the loading input is asserted.

7. A voltage regulation circuit for use with at least one switched magnetic tape write driver operating at a low voltage, the at least one write driver creating a switched write driver load, the circuit comprising:

a switched voltage regulator having an unregulated voltage input connected to an unregulated voltage source, a common input connected to common voltage, an enabling input, and a regulated voltage output supplying the write driver load, the voltage regulator operative to produce a regulated voltage at the output when the enabling input is asserted and to produce high impedance at the output when the enabling input is unasserted;

a capacitor connected between the regulated voltage output and the common voltage;

a controlled precharge switch in series with a precharge resistor connected between the unregulated source and the regulated voltage output, the precharge switch having a precharging input operative to close the precharge switch when the precharging input is asserted and to open the precharge switch when the precharging input is unasserted; and a control logic in communication with the enabling input and the precharging input, the control logic operative to (a) unassert the enabling input, (b) assert the precharging input to close the switch, (c) unassert the precharging input to open the switch after sufficient time to charge the capacitor to a voltage substantially the same as the regulated voltage, and (d) assert the enabling input.

8. A voltage regulation circuit as in claim 7, the switched write driver load enabled when a writing input is asserted and disabled when the writing input is unasserted, wherein the control logic is further operative to:

unassert the writing input at a time no later than when the precharging input is asserted; and assert the writing input at a time no earlier than when the precharging input is unasserted.

9. A voltage regulation circuit as in claim 7 further comprising a controlled preload switch in series with a preload resistor connected between the regulated voltage output and the common voltage, the preload switch having a preloading input operative to close the preload switch when the preloading input is asserted and to open the preload switch when the preloading input is unasserted, the control logic further in communication with the preloading input, wherein the control logic is operative to unassert the enabling input;

assert the precharging input to close the precharge switch;

unassert the precharging input to open the precharge switch after sufficient time to charge the capacitor to a voltage substantially the same as the regulated voltage;

assert the enabling input;

assert the preloading input to close the preload switch; and unassert the preloading input to open the preload switch after sufficient time to permit transient voltages on the regulated voltage output to decay.

10. A voltage regulation circuit as in claim 9, the switched write driver load enabled when a writing input is asserted and disabled when the writing input is unasserted, wherein the control logic is further operative to:

unassert the writing input at a time no later than when the precharging input is asserted; and assert the writing input at a time no earlier than when the preloading input is unasserted.

11. A voltage regulation circuit as in claim 10 wherein the control logic is further operative to assert the preloading input at a time no earlier than when the writing input is unasserted but before the precharging input is asserted so as to discharge the capacitor thereby; and unassert the preloading input at a time no later than when the precharging input is asserted.

12. A voltage regulation circuit as in claim 9 wherein the resistance value of the preload resistor is substantially the same as the write driver load.

13. A voltage regulation circuit as in claim 9 wherein the common voltage is ground, the precharge switch comprises a PMOS FET, and the preload switch comprises an NMOS FET.

* * * * *